US005438719A

United States Patent [19]

Anthony

[11] Patent Number: 5,438,719

[45] Date of Patent: Aug. 8, 1995

[54] INTEGRATED PILLOW CASE AND FITTED SHEET

[76] Inventor: Jerlean Anthony, 17175 San Juan, Detroit, Mich. 48221

[21] Appl. No.: 316,908

[22] Filed: Oct. 3, 1994

[51] Int. Cl.[6] ..... A47G 9/02

[52] U.S. Cl. ..... 5/485; 5/490; 5/497

[58] Field of Search ..... 5/485, 490, 497

[56] References Cited

U.S. PATENT DOCUMENTS

| | | | |
|---|---|---|---|
| 1,348,881 | 6/1920 | Christensen | 5/490 X |
| 2,662,233 | 12/1953 | Cheesman | 5/485 |
| 2,692,396 | 10/1959 | Cheesman | 5/485 |
| 3,638,251 | 2/1972 | Weiss . | |
| 3,639,251 | 2/1972 | Weiss | 5/490 |
| 3,800,340 | 4/1974 | Valentine | 5/485 |
| 4,014,055 | 3/1977 | Torres | 5/485 |
| 4,815,156 | 3/1989 | Williams | 5/485 |

*Primary Examiner*—Michael F. Trettel
*Attorney, Agent, or Firm*—Peter D. Keefe

[57] ABSTRACT

An integrated pillow case and fitted sheet, wherein the location of the pillow case is definitely defined with respect to the fitted sheet, and wherein the pillow contained therein is not readily accessible to a would-be pilferer. The integrated pillow case and fitted sheet is composed of a fitted sheet having conventional elastic portions for form fitting upon a mattress, and further has one or more pillow cases connected thereto. In a first example, a sheet slit having an upper side and a lower side is provided in the fitted sheet at the head thereof and a case slit also having an upper side and a lower side is provided in an otherwise closed pillow case. The upper side of the sheet slit and the case slit are mutually sewn together, as is the lower side thereof. A pillow is inserted into the pillow case through the mutually aligned sheet and case slits. A zipper or other releasable fastener, such as buttons, snaps or VELCRO (trademark of Velcro USA) type hook and loop fastener is preferably then used to close the mutually aligned sheet and case slits. One or more such pillow cases can be connected with the fitted sheet, In a second example, a pillow case is sewn along a seam to the head of a fitted sheet. An otherwise closed pillow case is provided with a slit adjacent to the seam. A pillow is inserted into the pillow case through the slit, The slit may or may not be closable using a releasable fastener such as a zipper, buttons, snaps or VELCRO. One or more such pillow cases can be connected with the fitted sheet, 6 Claims, 2 Drawing Sheets

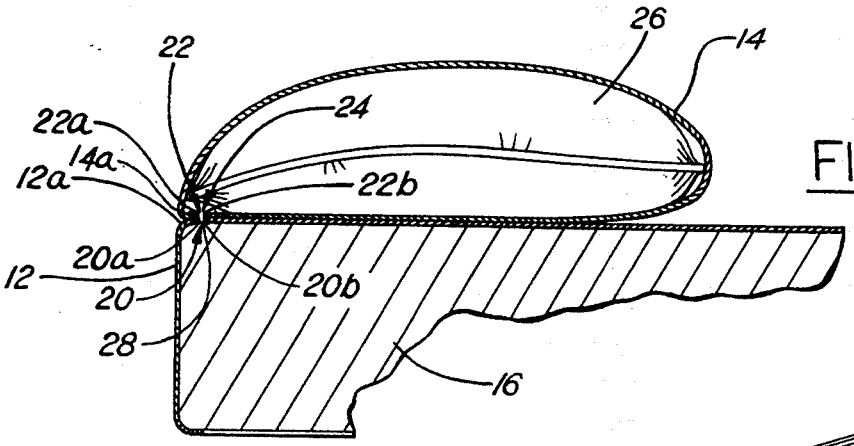
FIG.3
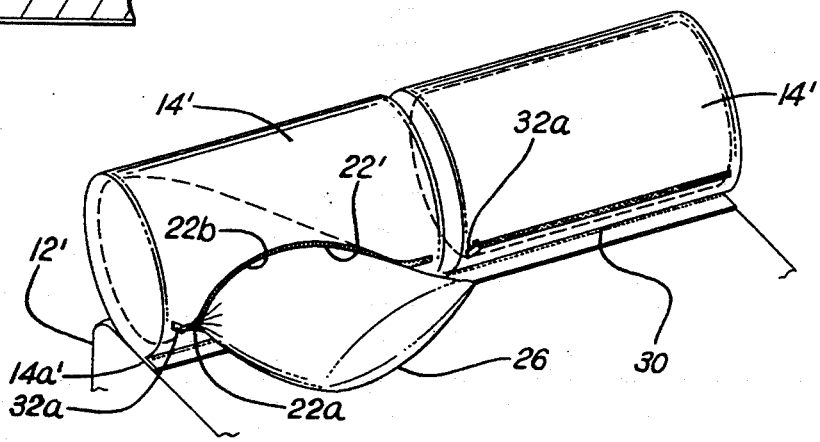
FIG.6
FIG.4
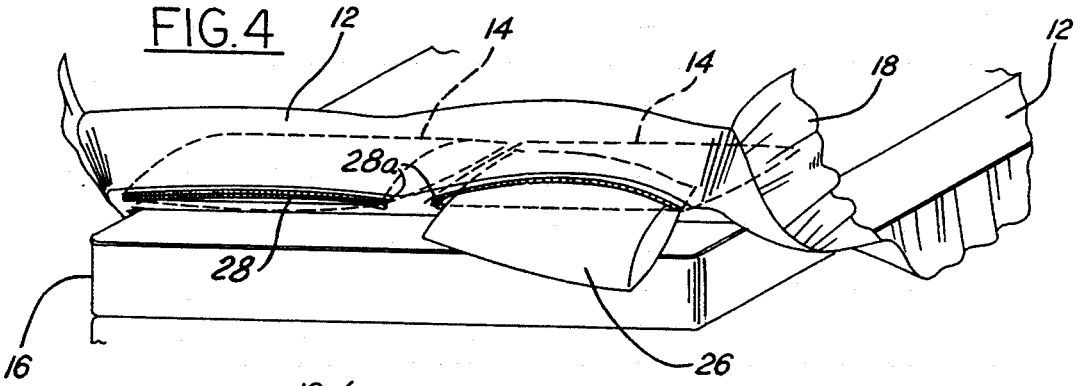
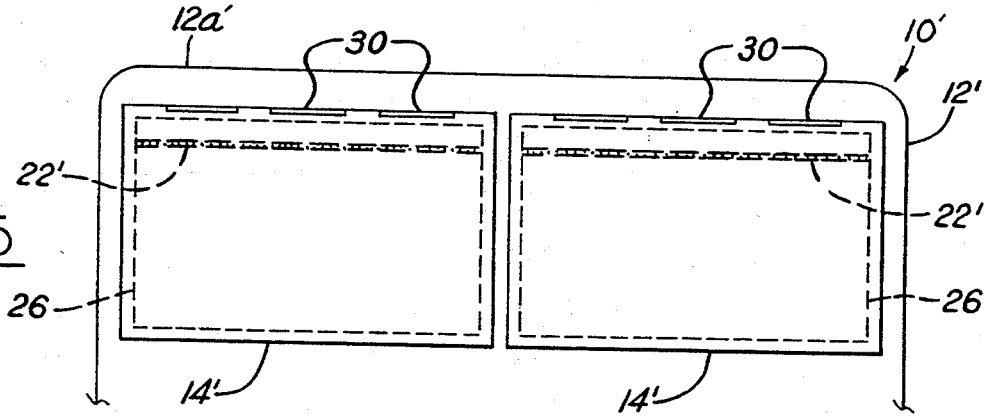
FIG.5

INTEGRATED PILLOW CASE AND FITTED SHEET

BACKGROUND OF THE INVENTION

1. Field of the invention

The present invention relates to bedding, wherein a fitted sheet form fits over the top portion of a mattress and pillow cases, each encasing a pillow, unconnectedly rest upon the fitted sheet at the head of the bed. More particularly, the present invention relates to one or more pillow cases, each respectively encasing a pillow, wherein the one or more pillow cases are connected with a fitted sheet to thereby trap the pillow in each of the pillow cases with respect to the fitted sheet.

2. Description of the Prior Art

Conventional bedding incorporates a mattress, usually involving a foam, spring, or a water filled mattress, which is located upon a frame of a bed. A person sleeps upon the top surface of the mattress. In this regard, a fitted sheet is used to cover the top portion of a mattress, wherein a fitted side portion of the fitted sheet has elastic corner portions that form fit around the sides and underside of the mattress to thereby provide smooth and secure coverage of the top surface of the mattress by the fitted sheet. The user places separate pillows upon the fitted sheet at the head of the bed for comfortable resting of his or her head when lying of the mattress. Each pillow is encased in a pillow case.

Problematically, it is the bane of hotel and motel establishments that persons lodging there may from time to time check out with one or more pillows of the lodging establishment contained in their luggage. Accordingly, it would be helpful if the pillow and pillow case could somehow be connected with the bedding so as to discourage pilfering of pillows.

Also, because pillows are separately laid upon the fitted sheet at the head of the bed, sometimes pillows can "wander" in the night as the sleeper knocks them around in his or her sleep. For example, just about everyone has experienced at some time or another a situation wherein they awake to find their pillow lying upon the floor next to the bed pillow "wandering" can become an even more annoying situation when a couple sleep together, each sleeper then affecting the position of the pillows as the night progresses. Accordingly, it would be beneficial if somehow a pillow could be definitely located with respect to the fitted sheet so that pillow "wandering" could be eliminated.

In the prior art, U.S. Pat. No. 3,638,251 to Weiss, dated Feb. 1, 1972 offers a teaching wherein the fitted sheet is provided with a gore panel to thereby provide a bulge area wherein a pillow may be located between the fitted sheet and the mattress. Weiss further teaches that the fitted sheet may be provided with a flange at the bulge furthest from the head of the bed to thereby simulate a real pillow. However, the essential teaching of Weiss is to provide a singular fitted sheet structure which obviates the need for a separate pillow case, and whether or not the flange is present, the fact remains that Weiss teaches a fitted sheet having a bulge for a pillow, the pillow case being absent.

Accordingly, what remains needed in the art is a fitted sheet having connected thereto one or more true pillow cases, wherein the pillow cases function in a conventional manner, yet are not subject to "wandering" and the pillows are not subject to pilfering.

SUMMARY OF THE INVENTION

The present invention is an integrated pillow case and fitted sheet, wherein the location of the pillow case is definitely defined with respect to the fitted sheet, and wherein the pillow contained therein is not readily accessible to a would-be pilferer.

The integrated pillow case and fitted sheet according to the present invention is composed of a fitted sheet having conventional elastic form fit portions for fitting upon a mattress, and further has one or more pillow cases connected thereto.

In a first example, a sheet slit having an upper side and a lower side is provided in the fitted sheet at the head thereof and a case slit also having an upper side and a lower side is provided in an otherwise closed pillow case. The upper side of each of the sheet slit and the case slit are mutually sewn together, as, respectively, is each of the lower sides thereof. A pillow is inserted into the pillow case through the mutually aligned sheet and case slits. A zipper or other releasable fastener, such as buttons, snaps or VELCRO (trademark of Velcro USA) type hook and loop fastener is then preferably used to close the mutually aligned sheet and case slits. One or more such pillow cases can be connected with the fitted sheet.

In a second example, a pillow case is sewn along a seam to the head of a fitted sheet. An otherwise closed pillow case is provided with a slit adjacent to the seam. A pillow is inserted into the pillow case through the slit The slit may or may not be closable using a releasable fastener such as a zipper, buttons, snaps or VELCRO. One or more such pillow cases can be connected with the fitted sheet These, and additional objects, advantages, features and benefits of the present invention will become apparent from the following specification.

BRIEF DESCRIPTION OF THE DRAWINGS

FIG. 3 is a partly broken away partly sectional side view of the first preferred form of the integrated pillow case and fitted sheet according to the present invention, shown in operation with respect to a mattress and a pillow, and seen along line 3—3 in FIG. 2.

FIG. 4 is a partly broken away perspective view of the integrated pillow case and fitted sheet according to the first preferred form of the present invention, shown in operation with respect to a mattress and pillows.

FIG. 5 is a partly broken away plan view of the first preferred form of the integrated pillow case and fitted sheet according to a second preferred form of the present invention, shown in operation with respect to a mattress and installation of a pillow.

FIG. 6 is a partly broken away perspective view of the integrated pillow case and fitted sheet according to the second preferred form of the present invention, shown in operation with respect to a mattress and pillows.

DETAILED DESCRIPTION OF TEE PREFERRED EMBODIMENT

Figure 1:
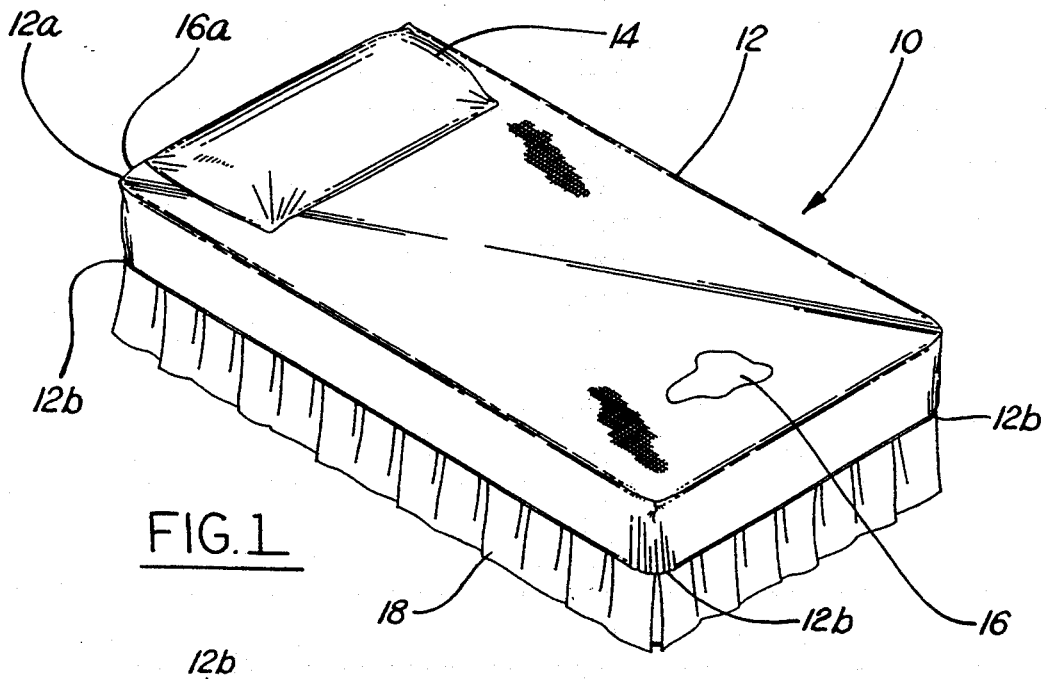
FIG. 1 is a perspective view of the integrated pillow case and fitted sheet according to a first preferred form of the present invention, shown in operation with respect to a mattress and pillow.
Figure 2:
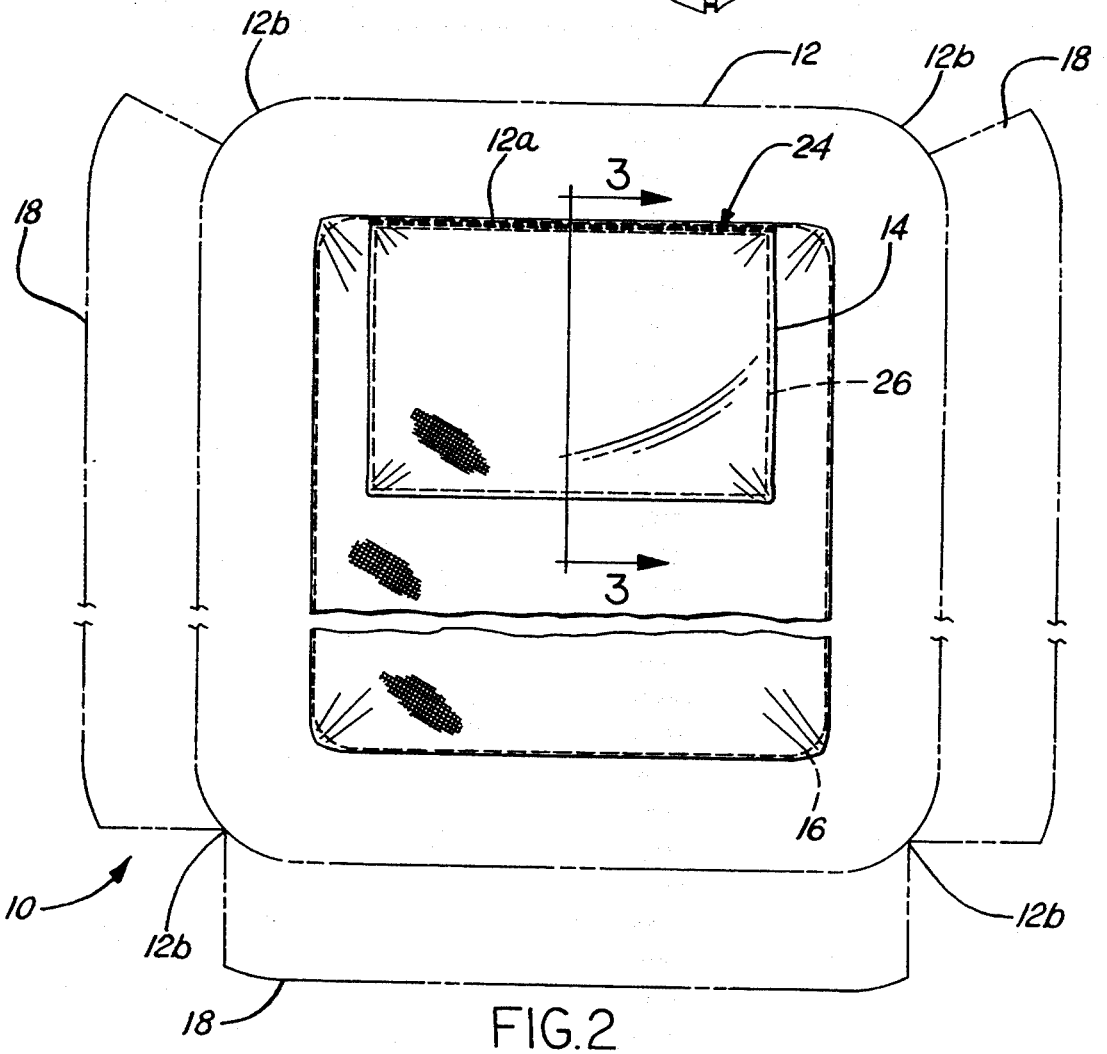
FIG. 2 is a plan view of the first preferred form of the integrated pillow case and fitted sheet according to the present invention.

Referring now to the Drawing, FIGS. 1 through 4 show a first preferred form of the integrated pillow case and fitted sheet 10 according to the present invention. It will be noted from reference to FIG. 1 that the integrated pillow case and fitted sheet 10 is composed of a fitted sheet 12 and one or more pillow cases 14 attached thereto. The fitted sheet 12 form fits over a mattress 16 in a generally conventional manner, wherein the pillow case 14 is located at the head 16*a* of the mattress, and whereat is located the head 12*a* of the fitted sheet. The pillow case 14 is connected with the fitted sheet 12 so that the location of the pillow case is defined and, as will become clear from the description hereinbelow, the pillow retained within the pillow case is not readily accessible.

The fitted sheet 12 is structured to form fit with respect to a mattress 16 in a generally conventional manner. In this regard, the fitted sheet 16 is composed of for example a combed cotton or other fabric material and elastic is provided at the bottom of the corners 12*b* so that the fitted sheet hugs the corners and underside of the mattress 16, thereby providing a smooth placement on the top surface of the mattress. The fitted sheet 12 may or may not include a skirt 18.

The fitted sheet 12 has one or more sheet slits 20 therein, each of which located adjacent the head 12*a* of the fitted sheet. There is one sheet slit 20 provided for each pillow case 14. As shown best in FIG. 3, each sheet slit 20 has an upper side 20*a* and an opposite lower side 20*b*.

A pillow case 14 is provided with respect to each of the sheet slits 20. In this regard, each pillow case 14 is everywhere closed except at a case slit 22 formed at a head end 14*a* thereof. The case slit 22 has an upper side 22*a* and a lower side 22*b*. As best shown in FIG. 3, the case slit 22 is aligned with a respective sheet slit 20. Thereupon, the upper side 20*a* of the sheet slit 20 is sewn to the upper side 22*a* of the case slit 22, and the lower side 20*b* of the sheet slit is sewn to the lower side 22*b* of the case slit. Accordingly, a sheet and case slit 24 is formed form the aligned interconnection of the sheet and case slits 20, 22.

As depicted in FIG. 4, a pillow 26 is slipped through the sheet and case slit 24 to thereby occupy the space within the pillow case 14 (see FIG. 3). As understood by reference to FIG. 3, the pillow case 14 and the pillow 26 therewithin lie upon the fitted sheet 12 in a generally normal manner, except that adjacent the fitted sheet head 12*a* the pillow case is connected with the fitted sheet. In this regard, the pillow case 14 is pivotable about its connection to the fitted sheet 12 and the sleeper can place their hand under the pillow case in a completely normal fashion and otherwise envy his or her pillow in a customary and familiar manner. Yet, the pillow 26 and pillow case 14 will be secured with respect to the fitted sheet so that they are unable to "wander" with respect thereto.

It is preferred for the sheet and case slit 24 to be selectively closable. In this regard, a releasable fastener is used to provide a selective opening through which the pillow 26 may pass, and to provide a selective closing which traps the pillow within the pillow case and which prevents the fitted sheet from becoming distorted during the sleeper's sleep in the event the sleeper tosses and turns such as to widen the spacing of the sheet and case slit. In this regard, the preferred releasable fastener is a zipper 28 having a head 28*a* which is operable from the sheet slit 20 side of the sheet and case slit 24, as shown in FIG. 4. Other releasable fasteners may be used, such as periodically spaced buttons, snaps, or VELCRO type hook and loop fasteners.

Referring now to FIGS. 5 and 6, a second preferred form of the integrated pillow case and fitted sheet 10' will be detailed.

It will be noted from reference to FIG. 5 that the integrated pillow case and fitted sheet 10' is composed of a fitted sheet 12' generally as described hereinabove with respect to the fitted sheet 12, except now there is no sheet slit therein. Each pillow case 14' is provided with a case slit 22' having an upper side 22*a'* and a lower side 22*b'*. Each pillow case 14' is sewn along a seam 30 to the fitted sheet adjacent the head 14*a'* thereof between a head end 14*a'* of the pillow case 14' and the case slit 22', as shown in FIG. 6. A releasable fastener, such as a zipper 32 having a head 32*a* (shown in FIG. 6), spaced buttons, snaps or VELCRO type hook and loop fasteners may be used to selectively close the upper and lower sides 22*a'*, 22*b'* of the case slit 22'.

As depicted in FIG. 6, a pillow 26 is inserted into each pillow case 14' by passage through the case slit 22'. The pillow case 14' is then pivoted on the sewed seam 30 connection so that the pillow case 14' lies on the fitted sheet 12' generally as described hereinabove, wherein operation of the pillow with respect to the sleeper is essentially normal and customary, but with the added benefit that the pillow case 14' is affixed to the fitted sheet 12' to thereby prevent "wandering" thereof.

In either of the first and second preferred forms of the integrated pillow case and fitted sheet 10, 10', it will be noted that provided are the dual advantageous purposes of eliminating pillow "wandering" and making access to the pillow difficult for would-be pilferers, while still providing operation of the pillow case in a substantially normal and accustomed manner for the sleeper who is using it This latter feature, wherein the pillow case operates in a manner that is normal and accustomed is a benefit to those sleepers who can't sleep unless their bedding operates in a manner that has become for them habitual.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An integrated pillow case and fitted sheet for being used with respect to a mattress and at least one pillow, the mattress having a head, said integrated pillow case and fitted sheet comprising:

a fitted sheet structured for form fitting with respect to a mattress having a head; and at least one pillow case connected to said fitted sheet, each pillow case of said at least one pillow case comprising a pillow case having a head end and a case slit therein adjacent said head end, each said pillow case being everywhere closed except at said case slit, wherein a pillow is passed through said case slit to be thereupon encased by a selected said pillow case;

wherein the fitted sheet has a head which is located at the head of the mattress when said fitted sheet is form fitted onto the mattress, said at least one pillow case being connected to said fitted sheet adjacent said head of said fitted sheet and adjacent said head end of each said pillow case; wherein further, each said pillow case lies on said fitted sheet whereupon each said pillow case is free to pivot with respect to said fitted sheet about said connection of each said pillow case to said fitted sheet.

2. The integrated pillow case and fitted sheet of claim 1, further comprising releasable fastener means connected with each said case slit for providing selective closure of each said case slit.

3. The integrated pillow case and fitted sheet of claim 2, further comprising a skirt connected with said fitted sheet.

4. An integrated pillow case and fitted sheet for being used with respect to a mattress and at least one pillow, the mattress having a head, said integrated pillow case and fitted sheet comprising:

a fitted sheet structured for form fitting with respect to a mattress having a head, wherein the fitted sheet has a head which is located at the head of the mattress when said fitted sheet is form fitted onto the mattress, said fitted sheet having at least one sheet slit adjacent said head of said fitted sheet, each sheet slit having an upper side and an opposite lower side; and at least one pillow case connected to said fitted sheet, each pillow case of said at least one pillow case comprising a pillow case having a head end and a case slit therein adjacent said head end, said case slit having an upper side and an opposite lower side, said at least one pillow case being connected to said fitted sheet adjacent said head of said fitted sheet and adjacent said head end of each said pillow case; each said pillow case being everywhere closed except at said case slit, said sheet slit being aligned with said case slit whereupon said upper side of said sheet slit is connected with said upper side of said case slit and said lower side of said sheet slit is connected with said lower side of said case slit to thereby form a sheet and case slit, wherein a pillow is passed through said sheet and case slit to be thereupon encased by a selected said pillow case;

wherein said at least one pillow case lies on said fitted sheet whereupon each said pillow case is free to pivot with respect to said fitted sheet about said connection of each said pillow case respectively to said fitted sheet.

5. The integrated pillow case and fitted sheet of claim 4 further comprising releasable fastener means connected with each said sheet and case slit for providing selective closure of each said case and sheet slit from the case slit side respectively of each said sheet and case slit.

6. The integrated pillow case and fitted sheet of claim 5, further comprising a skirt connected with said fitted sheet.

* * * * *